US008663550B2

(12) United States Patent
Valls Anglés

(10) Patent No.: US 8,663,550 B2
(45) Date of Patent: Mar. 4, 2014

(54) HOT WORK TOOL STEEL WITH OUTSTANDING TOUGHNESS AND THERMAL CONDUCTIVITY

(75) Inventor: Isaac Valls Anglés, Barcelona (ES)

(73) Assignee: Rovalma, S.A., Terrasa (ES)

( * ) Notice: Subject to any disclaimer, the term of this patent is extended or adjusted under 35 U.S.C. 154(b) by 59 days.

(21) Appl. No.: 13/257,417

(22) PCT Filed: Mar. 12, 2010

(86) PCT No.: PCT/EP2010/053179

§ 371 (c)(1),
(2), (4) Date: Dec. 5, 2011

(87) PCT Pub. No.: WO2010/112319

PCT Pub. Date: Oct. 7, 2010

(65) Prior Publication Data

US 2012/0063946 A1 Mar. 15, 2012

(30) Foreign Application Priority Data

Apr. 1, 2009 (EP) ..... 09382044

(51) Int. Cl.
*C22C 38/08* (2006.01)
*C22C 38/44* (2006.01)

(52) U.S. Cl.
USPC ..... 420/119; 420/108; 420/109; 420/112; 420/113; 148/335; 148/336

(58) Field of Classification Search
USPC ..... 420/120–124, 108, 109, 112, 119; 148/336, 335
See application file for complete search history.

(56) References Cited

U.S. PATENT DOCUMENTS 3,366,471 A * 1/1968 Matas et al. ..... 420/8

FOREIGN PATENT DOCUMENTS

| | | | | |
|---|---|---|---|---|
| EP | 0 632 139 | A1 | | 1/1995 |
| EP | 1 887 096 | A1 | | 2/2008 |
| JP | 358123860 | A | * | 7/1983 |
| JP | 04026739 | A | * | 1/1992 |
| JP | 04 147706 | A | | 5/1992 |
| JP | 11 222650 | A | | 8/1999 |

* cited by examiner

*Primary Examiner* — Deborah Yee
(74) *Attorney, Agent, or Firm* — Ladas & Parry LLP

(57) ABSTRACT

A hot work tool steel family with exceptional thermal diffusivity, toughness (both fracture toughness and notch sensitivity resilience CVN—charpy V-notch) and trough hardenability has been developed. Mechanical resistance and yield strength at room and high temperatures (above 600° C.) are also high, because the tool steels of the present invention present a high alloying level despite the high thermal conductivity. Given the exceptional resistance to thermal fatigue and thermal shock, wear resistance can be severely increased for many applications requiring simultaneously resistance to thermal cracking and wear like is the case for some forging and some parts of die casting dies.

18 Claims, No Drawings

HOT WORK TOOL STEEL WITH OUTSTANDING TOUGHNESS AND THERMAL CONDUCTIVITY

FIELD OF THE INVENTION

The present invention relates to a hot work tool steel with very high thermal conductivity and low notch sensitivity conferring an outstanding resistance to thermal fatigue and thermal shock. The steel also presents a very high through-hardenability.

SUMMARY

Hot work tool steels employed for many manufacturing processes are often subjected to high thermo-mechanical loads. These loads often lead to thermal shock or thermal fatigue. For most of these tooling the main failure mechanisms comprise thermal fatigue and/or thermal shock, often in combination with some other degradation mechanisms like mechanical fatigue, wear (abrasive, adhesive, erosive or even cavitative), fracture, sinking or other means of plastic deformation, to mention the most relevant. In many other applications besides the above referred tools, materials are employed that also require high resistance to thermal fatigue often in combination with resistance to other failure mechanisms.

Thermal shock and thermal fatigue are originated by thermal gradients, in many applications where stationary transmission regimes are not attained, often due to small exposure times or limited energy amount of the source leading to a temperature decay, the magnitude of the thermal gradient in the tool material is also a function of its thermal conductivity (inverse proportionality applies for all cases with small enough Biot number).

In such scenario, for a given application with a given heat flux density function, a material with a higher thermal conductivity suffers a lower surface loading, since the resulting thermal gradient is lower.

Traditionally for many applications where thermal fatigue is the main failure mechanism, like in many instances of high pressure die casting, the measurement of toughness most widely used to evaluate different tool materials is the V-shape notched specimen resilience test (CVN—Charpy V-notch). Other measures can also be used, and are even more representative for some applications, like fracture toughness or yield deformation, deformation at fracture . . . . This measurements together with mechanical resistance related measurements (like yield stress, mechanical resistance or fatigue limit), wear related measurements (normally K-weight loss in some tribometric test) can be used as indicators of material performance for comparative purposes amongst different tool material candidates.

Therefore a merit number to compare the theoretical resistance of different materials for a given application can be:

$$Me{\cdot}Nr = \mathrm{CVN} \neq k/(E{\cdot}\alpha)$$

Where:

CVN—Charpy V-notched k—Thermal conductivity

E—Elastic modulus

α—Thermal expansion coefficient

In most scientific literature the CVN term would be replaced by $K_{IC}$, mechanical fatigue resistance, or yield strength at working temperature. But the above presented example of Merit number, is arguably one of the most intuitive amongst industrial specialists.

It is then clear that to improve thermal fatigue resistance, attempts should be made to simultaneously increase thermal conductivity, toughness and decrease elastic modulus and thermal expansion coefficient.

For many applications, thick tools are used, and thus if sufficient mechanical resistance is required as to entail heat treatment, then great trough hardenability is also desirable. Hardenability is also very interesting for hot work tool steels because it is much easier to attain a higher toughness with a tempered martensite microstructure than with a tempered bainite microstructure. Thus with higher hardenability less severity in the hardening cooling is required. Severe cooling is more difficult and thus costly to attain and since the shapes of the tools and components constructed are often intricate, it can lead to cracking of the heat treated parts.

Wear resistance and mechanical resistance are often inversely proportional to toughness. So attaining a simultaneous increase in wear resistance and resistance to thermal fatigue is not trivial. Thermal conductivity helps in this respect, by allowing to severely increase resistance to thermal fatigue, even if CVN is somewhat lowered to increase wear or mechanical resistances.

There are many other properties which are desirable, if not required, for a hot work tool steel which not necessarily have an influence on the tool or component longevity but on its production costs, like: ease of machining, weldability or reparability in general, support provided to coating, cost, . . . .

In the present invention a family of tool materials with improved resistance to thermal fatigue and thermal shock, which can be combined with better resistance to mechanical collapse or wear, have been developed. Those steels also present an improved trough hardenability and CVN with respect to other existing high mechanical characteristic with high thermal conductivity tool steels (WO/2008/017341).

The authors have found that the problem of attaining simultaneously a high thermal conductivity, trough hardenability, toughness and mechanical characteristics, can be solved by applying certain compositional rules and thermo-mechanical treatments within the following compositional range:

| | | | |
|---|---|---|---|
| % Ceq = 0.20-1.2 | % C = 0.20-1.2 | % N = 0-1 | % B = 0-1 |
| % Cr < 1.5 | % Ni = 1.0-9 | % Si < 0.4 | % Mn = 0-3 |
| % Al = 0-2.5 | % Mo = 0-10 | % W = 0-15 | % Ti = 0-3 |
| % Ta = 0-3 | % Zr = 0-3 | % Hf = 0-3, | % V = 0-4 |
| % Nb = 0-3 | % Cu = 0-4 | % Co = 0-6, | % S = 0-1 |
| % Se = 0-1 | % Te = 0-1 | % Bi = 0-1 | % As = 0-1 |
| % Sb = 0-1 | % Ca = 0-1, | | |

the rest consisting of iron and unavoidable impurities, wherein $$\%\ Ceq = \%\ C + 0.86 * \%\ N + 1.2 * \%\ B,$$

characterized in that $$\%\ Mo + \tfrac{1}{2} \cdot \%\ W > 1.2.$$

The more restrictive one can be with the % Si and % Cr the better the thermal conductivity but the more expensive the solution becomes (also some properties, that might be relevant for certain applications, and thus it is desired to maintain them for those applications, might deprave with the reduction of those elements under certain levels like is for example the toughness due to trapped oxide inclusions if too low Al, Ti, Si (and any other deoxidizer) are used, or certain instances of corrosion resistance if % Cr or % Si are too low) and thus a compromise is often attained between the cost increase, reduction of toughness, corrosion resistance or other characteristics relevant for certain applications, and the benefit of a higher thermal conductivity. The highest thermal conductivity can only be attained when the levels of % Si and % Cr lie below 0.1% and even better if the lay below 0.5%. Also the levels of all other elements besides % C, % Mo, % W, % Mn and % Ni need to be as low as possible (less than 0.05 is technologically possible with a cost assumable for most applications, of course less than 0.1 is less expensive to attain). For several applications where toughness is of special relevance, less restrictive levels of % Si (is the less detrimental to thermal conductivity of all iron deoxidizing elements) have to be adopted, and thus some thermal conductivity renounced upon, in order to assure that the level of inclusions is not too high. Depending on the levels of % C, % Mo, and % W used, trough hardenability might be enough, especially in the perlitic zone. To increase trough hardenability in the Bainitic zone, Ni is the best element to be employed (the amount required is also a function, besides the aforementioned, of the level of certain other alloying elements like % Cr, % Mn, . . . ). . The levels of % Mo, % W and % C used to attain the desired mechanical properties, have to be balanced with each other to attain high thermal conductivity, so that as little as possible of these elements remain in solid solution in the matrix. Same applies with all other carbide builders that could be used to attain certain tribological response (like % V, % Zr, % Hf, % Ta, . . . ).

In the whole document the term carbides refers to both primary and secondary carbides.

In general, it is convenient to attain figh thermal conductivity to adhere to the following alloying rule (to minimize the % C in solid solution), if a tempered martensite or tempered bainite microstructure is desirable for the mechanical solicitations to be withstood. The formula has to be corrected if strong carbide binders (like Hf, Zr or Ta or even Nb are used):

$$0.03<xCeq-AC\cdot[xMo/(3\cdot AMo)+xW/(3\cdot AW)+xV/AV]<0.165$$

where:

$xC_{eq}$—weight percent Carbon;
xMo—weight percent Molybdenum;
xW—weight percent Tungsten;
xV—weight percent Vanadium;
AC—carbon atomic mass (12.0107 u);
AMo—molybdenum atomic mass (95.94 u);
AW—tungsten atomic mass (183.84 u);
AV—vanadium atomic mass (50.9415 u).

It is even more desirable, for a further improved thermal conductivity to have:

$$0.05<xCeq-AC\cdot[xMo/(3\cdot AMo)+xW/(3\cdot AW)+xV/AV]<0.158$$

And even better:

$$0.09<xCeq-AC\cdot[xMo/(3\cdot AMo)+xW/(3\cdot AW)+xV/AV]<0.15$$

To correct for the presence of other strong carbide builders, an extra term for each type of strong carbide builder has to be added in the formula:

$$-AC*xM/(R*AM)$$

Where:

xM—Weight percent carbide builder;
AC—Carbon atomic mass (12.0107 u);
R—Number of units of carbide builder per unit of carbide (p.e. 1 if carbide type is MC, 23/7 if carbide type were M23C7 . . . )
AM—Carbide builder atomic mass (? u);

This balancing provides an outstanding thermal conductivity if the ceramic strengthening particle building elements, including the non-metallic part (% C, % B, and % N) are indeed driven to the carbides (alternatively nitrides, borides or in-betweens). Thus the proper heat treatment has to be applied. This heat treatment will have an stage where most elements are brought into solution (austenization at a high enough temperature, normally above 1040° C. and often above 1080° C.), quenching will follow, the severity determined mainly by the mechanical properties desired, but stable microstructures should be avoided because they imply phases with a great amount of % C and carbide builders in solid solution. Meta-stable microstructures are even worse per se, since the distortion in the microstructure caused by carbon is even greater, and thus thermal conductivity lower, but once those meta-stable structures are relaxed is when the carbide builders find themselves in the desired placement. So tempered martensite and tempered bainite will be the sought after microstructures in this case.

In a generic way it can be said, that the higher the Mn and Si content used pursuing some specific properties, the lower the % Ni used should be, because the effect on the matrix electron thermal conductivity is too high. This can be coarsely represented by:

$$\%\ Ni+9*\%\ Mn+5*\%\ Si<9$$

or even better when the upper limit can be reduced to 8% in weight.

Machinability enhancers like S, As, Te, Bi or even Pb can be used. The most common one of them, Sulphur has a comparatively low negative effect on the thermal conductivity of the matrix in the levels normally employed to enhance machinability, but it's presence has to be well balanced with the presence of Mn, to try to have all of it in the form of spherical, less detrimental to toughness, Manganese disulphide, and as little as possible of the two elements remaining in solid solution if thermal conductivity is to be maximized.

As it was mentioned before, attaining a low level of certain elements in the steels is expensive due to technological limitations. For example a steel rated as not having Cr (0% Cr in nominal composition), especially if it is an alloyed quality tool steel, will most likely have an actual % Cr>0.3%. Not mentioning % Cr, in a composition means it is not considered important, but also not its absence.

The case of % Si is a bit different, since its content can at least be reduced by the usage of refining processes like ESR, but here it is very technologically difficult, due to the small process window (and thus costly, and therefore will only be done when there's an underlying purpose) to reduce the % Si under 0.2% and simultaneously attain a low level of inclusions (specially oxides). All existing tool steel that by nominal composition range could have high thermal conductivity, do not because of the following two main reasons:—The ratio of % C and that of the carbide builders is not well balanced to minimize solid solution in the metallic matrix, especially of % C. It is often so because solid solution is intentionally employed to increase mechanical resistance.

The levels of % Si and % Cr, for example, can be % Cr<1 (or even no mention to % Cr where it can be wrongly induced that it is 0%) and % Si<0.4 which means they end up being % Cr>0.3 and % Si>0.25. That also applies to all trace elements with strong incidence in matrix conductivity and even more those that have high solubility in the carbides and big structure distorting potential. In general besides % Ni, and in some instances % Mn, no other element is desired in solution within the matrix in excess of 0.5%. Preferably this quantity should not exceed 0.2%. If maximizing thermal conductivity is the main objective for a given application, then any element, other than % Ni and in some instances % C and % Mn, in solution in the matrix should not exceed 0.1% or even better 0.5%.

DETAILED DESCRIPTION OF THE INVENTION

For hot work tool steels, toughness is one of the most important characteristics, specially notch sensitivity resistance and fracture toughness. Unlike cold work applications where once enough toughness is provided to avoid cracking or chipping, extra toughness does not provide any increase in the tool life, in hot work applications where thermal fatigue is a relevant failure mechanism, tool life is directly proportional to toughness (both notch sensitivity and fracture toughness). Another important mechanical characteristic is the yield strength at the working temperature (since yield strength decreases with increasing temperature), and for some applications even creep resistance. Mechanical resistance and toughness tend to be inversely proportional, but different microstructures attain different relations, that is to say different levels of toughness can be achieved for the same yield strength at a given temperature as a function of the microstructure. In that respect it is well known that for most hot work tool steels a purely tempered martensite microstructure is the one offering the best compromise of mechanical properties. That means that it is important to avoid the formation of other microstructures like stable ferrite-perlite or metastable bainite during the cooling after austenization in the heat treatment process. Therefore fast cooling rates are going to be needed, or when even more trough hardenability is desired, some alloying elements to retard the kinetics of the formation of those more stable structures should be employed, and from all possible alternatives those with the smallest negative effect in thermal conductivity should be employed.

One strategy to provide wear resistance and higher yield strength at high temperatures while attaining a high thermal conductivity is the employment of high electron density $M_3Fe_3C$ secondary and sometimes even primary carbides (M—should only be Mo or W for an improved thermal conductivity). There are some other (Mo, W, Fe) carbides with considerable high electron density and tendency to solidify with little structural defects. Some elements like Zr and to lesser extend Hf and Ta can dissolve into this carbides with lesser detrimental effect to the regularity of the structure, and thus scattering of carriers and therefore conductivity, than for example Cr and V, and they also tend to form separate MC carbides due to their high affinity for C. In general it is wished to have predominantly (Mo, W, Fe) carbides (where of course part of the % C can be replaced by % N or % B), usually more than 60% and optimally more than 80% or even 90% of such kind of carbides. Little dissolutions of other metallic elements (obviously in the case of carbides it those metallic elements will normally be transition elements) can be present in the carbides but it is desirable to limit them to guarantee a high phonon conductivity. Normally no other metallic element besides Fe, Mo and W should exceed 20% of the weight percent of the metallic elements of the carbide. Preferably it should not be more than 10% or even better 5%. This is often the case because they tend to form structures with extremely low densities of solidification defects even for high solidification kinetics (thus less structural elements to cause scattering of carriers). In this case enough impediments to the formation of stable structures (perlite and ferrite) is provided by the Mo and W, but formation of Bainite happens very fast. For some steels super-bainitic structures can be attained by applying a martempering type of heat treatment, consisting on a complete solubilisation of alloying elements and then a fast cooling to a certain temperature (to avoid the formation of ferrite) in the range of lower bainite formation, and a long holding of the temperature to attain a 100% bainitic structure. For most steels a pure martensitic structure is desired, and thus in that system some elements have to be added to retard the bainitic transformation since Mo and W are very inefficient in that respect. Normally Cr is employed for this purpose but it has an extremely negative effect in the thermal conductivity for this system since it dissolves ion the $M_3Fe_3C$ carbides and causes a great distortion, so it is much better to use elements that do not dissolve into the carbides. Those elements will lower the matrix conductivity and thus those with the smallest negative effect should be employed. A natural candidate is then Ni, but some others can be employed parallelly. Normally between 3% and 4% will suffice to get the desired hardenability and contribute to increase toughness without hampering conductivity excessively. For some applications less % Ni brings also the desired effects, especially if % Mn and % Si are a bit higher, or smaller sections are to be employed. So 2%-3% or even 1%-3% Ni might suffice for some applications. Finally in some applications where CVN is priorized to maximum thermal conductivity, higher % Ni contents will be employed normally up to 5.5% and exceptionally up to 9%. One further advantage of the usage of % Ni, is that it tends to lower the thermal expansion coefficient for this kind of steels at this concentration levels, with the consequent advantage for thermal fatigue (higher Merit number).

The usage of only % Mo is somewhat advantageous for thermal conductivity, but has the disadvantage of providing a higher thermal expansion coefficient, and thus lowering the overall resistance to thermal fatigue. Thus it is normally preferred to have from 1.2 to 3 times more Mo than W, but not absence of W. An exception are the applications where only thermal conductivity is to be maximized together with toughness but not particularly resistance to thermal fatigue.

When remaining in the $Mo_xW_{3-x}Fe_3C$ carbide system and keeping the levels of Cr as low as possible, one preferred way to balance the contents of % W, % Mo and % C is by adhering to the following alloying rule:

$$\%\ Ceq = 0.3 + (\%\ Mo_{eq} - 4) - 0.04173$$

Where: $Mo_{eq}$=% Mo+½% W.

The variation allowed in the % Ceq resulting from the preceding formula, in order to optimize some mechanical or tribological property, while maintaining the desired high thermal conductivity is:

Optimally: −0.03/+0.01;

Preferably: −0.05/+0.03

Admissibly: −0.1/+0.06

This alloying rule might be reformulated in a way that better suits different % C alloys, and thus different applications:

$$\%\ C_{eq}(\text{preliminary}) = \%\ Mo_{eq} - 0.04173$$

Where: $Mo_{eq}$=% Mo+½% W.

And then,

If % $C_{eq}$ (preliminary)<=0.3 then % $C_{eq}$(final)=% $C_{eq}$ (preliminary)+$K_1$ If % $C_{eq}$ (preliminary)>0.3 then % $C_{eq}$(final)=% $C_{eq}$(preliminary)+$K_2$ Where $K_1$ and $K_2$ are chosen to be:

Optimally: $K_1$ within [0.10; 0.12]; and K2 within [0.13; 0.16]

Preferably: $K_1$ within [0.08; 0.16]; and $K_2$ within [0.12; 0.18]

Admissibly: $K_1$ within [0.06; 0.22]; and $K_2$ within [0.10; 0.25]

In this case the hardenability to avoid Ferrite or perlite formation is good for % C above 0.25%. But if bainite formation is to be avoided, Ni is required in a quantity normally exceeding 3%.

Other strengthening mechanisms can be employed, searching for some specific mechanical property combination, or resistance to the degradation caused by the working environment. Always the desired property is tried to maximize having the smallest possible negative effect on the thermal conductivity. Solid solution with Cu, Mn, Ni, Co, Si . . . (including some carbide builders with lesser carbon affinity like Cr) and interstitial solid solution (mainly C, N and B). Also precipitation can be employed for this purpose, with intermetallics formation like $Ni_3Mo$, NiAl, $Ni_3Ti$ . . . (and thus besides Ni and Mo, the elements Al, Ti can be added in small amounts, specially Ti which does solve in the $M_3Fe_3C$ carbide). And finally other types of carbides can be used, but it is normally then far more difficult to maintain a high thermal conductivity level, unless the carbide formers have a very high affinity for carbon like is the case for Hf, Zr, and even Ta. Nb and V are normally used to reduce the cost at which a certain tribological response is attained, but they have a strong incidence on thermal conductivity, so they will only be used when cost is an important factor, and in smaller quantities. Some of those elements are also not so detrimental when they solve into the $M_3Fe_3C$ carbide, this is specially the case for Zr, and with lesser extend for Hf and Ta.

Whether the quantity of an element employed is big or small, when quantity is measured in weight percentiles, is a factor of the atomic mass and the type of carbide formed. To serve as an example a 2% V is much more than a 4% W. V tends to form MC type of carbides, unless it comes into solution with other existing carbides. So only one unit of V is needed to form one unit of carbide, and the atomic mass is 50.9415. W tends to form M3Fe3C type of carbides in hot work tool steels. So three units of W are needed to form one unit of carbide, and the atomic mass is 183.85. Therefore 5.4 times more units of carbide can be formed with 2% V than with 4% W.

Until the development of the High thermal conductivity tool steels (WO/2008/017341), the only means known to increase thermal conductivity of a tool steel was to keep low alloying and thus having poor mechanical characteristics, specially at high temperatures. Hot work tool steels capable of attaining more than 42 HRC after prolonged exposure to 600° C. or more, were believed to have a upper limit in thermal conductivity of 30 W/mK and in thermal diffusivity of 8 $mm^2/s$. The tool steels of the present invention while having those mechanical properties and a good trough hardenability present a Thermal diffusivity in excess of those 8 $mm^2/s$, and in general above 11 $mm^2/s$. Thermal diffusivity is chosen as the relevant thermal property because it is easier to measure with accuracy, and because most tools are applied in cyclical processes, and then thermal diffusivity is even more relevant to evaluate performance than thermal conductivity.

The tool steel of the present invention can be produced by any metallurgical route, being the most common: sand casting, fine casting, continuous casting, electric furnace melting, vacuum induction melting. Also powder metallurgy ways can be used including any kind of atomization and posterior compactation method like HIP, CIP, cold or hot pressing, sintering, thermal spraying or cladding to mention some. The alloy can be obtained directly with desired shape or further metallurgically improved. Any refining metallurgical processes might be applied like ESR, AOD, VAR . . . forging or rolling will often be employed to improve toughness, even tri-dimensional forging of blocks. The tool steel of the present invention can be obtained as a rod, wire or powder to be employed as welding alloy during welding. Even a die can be constructed by using a low cost casting alloy and supplying the steel of the present invention on the critical parts of the die by welding with a rod or wire made of a steel of the present invention or even laser, plasma or electron beam welded using powder made of the steel of the present invention. Also the tool steel of the present invention could be used with any thermal projection technique to supply it to parts of the surface of another material.

The tool steel of the present invention can also be used for the construction of parts suffering big thermomechanical loads, or basically any part prone to fail due to thermal fatigue, or with high toughness requirements and benefiting from a high thermal conductivity. The benefit coming from a faster heat transport or the lower working temperature. As examples: components for combustion engines (like motor block rings), reactors (also in the chemical industry), heat exchanging devices, generators or in general any machine for energy transformation. Dies for the forging (in open or closed die), extrusion, rolling, casting and tixo-forming of metals. Dies for the plastic forming in all its forms of both thermoplastic and thermosetting materials. In general any die, tool or piece that can benefit from an improved resistance to thermal fatigue. Also dies, tools or pieces benefiting from an improved thermal management, like is the case of dies for the forming or cutting of materials liberating great energy amounts (like stainless steel) or being at high temperature (hot cutting, press hardening).

EXAMPLES

Some examples are provided of how the steel composition of the invention can be more precisely specified for different typical hot working applications:

Example 1

For aluminium die casting of heavy pieces with considerable wall thickness, in this case as high as possible thermal conductivity is desired but with very high trough hardenability for a purely martensitic microstructure and notch sensitivity should be as low as possible, and fracture toughness as high as possible. This solution maximizes thermal fatigue resistance with a very good trough hardenability since the dies or parts constructed with the hot work tool steel have often very heavy sections. In this case such compositional range could be employed:

$C_{eq}$: 0.3-0.34 Cr<0.1 (preferably % Cr<0.05%) Ni: 3.0-3.6 Si: <0.15 (preferably % Si<0.1 but with acceptable level of oxides inclusions)

Mn: <0.2 $Mo_{eg}$: 3.5-4.5

Where $Mo_{eq}$=% Mo+½% W

All other elements should remain as low as possible and in any case under 0.1%.

All values are in weight percent.

The relevant properties attainable are shown with two examples:

| % C | % Mo | % W | % Ni | % Cr | % Si | % Mn | CVN J | Thermal diffusivity $mm^2/S$ Tamb | 400° C. |
|---|---|---|---|---|---|---|---|---|---|
| 0.31 | 3.2 | 1.9 | 3.2 | 0.05 | 0.12 | 0.19 | 39 | 13.2 | 8.7 |
| 0.32 | 3.3 | 1.9 | 3.4 | 0.07 | 0.15 | 0.23 | 50 | 12.3 | 8.3 |

Example 2

For closed die forging. In this case a simultaneous optimization of wear resistance and thermal fatigue resistance has to be attained, so maximum CVN, and thermal diffusivity are desirable with an increased wear resistance (presence of primary carbides). In this case, Powder metallurgical tool steels within the following compositional range could be employed:
$C_{eq}$: 0.34-0.38 Cr<0.1 (preferably % Cr<0.05%) Ni: 3.0-3.6
Si: <0.15 (preferably % Si<0.1 but with acceptable level of oxides inclusions)
Mn: <0.2 $Mo_{eq}$: 5.0-7.0
Where $Mo_{eq}$=% Mo+½% W All other elements should remain as low as possible and in any case under 0.1%. All values are in weight percent.

The relevant properties attainable are shown with two examples:

| % C | % Mo | % W | % Ni | % Cr | % Si | % Mn | CVN J | Thermal diffusivity $mm^2/s$ Tamb | 400° C. |
|---|---|---|---|---|---|---|---|---|---|
| 0.345 | 4.4 | 3.4 | 3.1 | 0.05 | 0.05 | 0.20 | 36 | 12.4 | 8.5 |
| 0.357 | 4.6 | 3.5 | 3.4 | 0.07 | 0.11 | 0.21 | 32 | 12.2 | 8.4 |

Example 3

For hot cutting of sheets. In this case wear resistance has to be maximized, with a good trough hardenability and toughness. Thermal conductivity is very important to keep the temperature at the cutting edge as low as possible. In this case such compositional range could be employed:
Ceq: 0.72-0.76 Cr<0.1 (preferably % Cr<0.05%) Ni: 3.4-4.0
Si: <0.15 (preferably % Si<0.1) Mn: <0.4 $Mo_{eq}$: 12-16
Where $Mo_{eq}$=% Mo+½% W All other elements should remain as low as possible and in any case under 0.1%.

All values are in weight percent.

The relevant properties attainable are shown with two examples:

| % C | % Mo | % W | % Ni | % Cr | % Si | % Mn | Resil | Thermal diffusivity $mm^2/S$ Tamb | 400° C. |
|---|---|---|---|---|---|---|---|---|---|
| 0.74 | 10 | 8 | 3.5 | 0.04 | 0.045 | 0.21 | 39 | 11.0 | 7.7 |

The invention claimed is:

1. A steel, for a hot work tool steel, having the following composition, all percentages being in weight percent:

| | | | |
|---|---|---|---|
| % Ceq = 0.26-0.55 | % C = 0.20-0.55 | % N = 0-0.6 | % B = 0-0.45 |
| % Cr < 1.5 | % Ni = 1.0-9 | % Si < 0.4 | % Mn = 0-3 |
| % Al = 0-2.5 | % Mo = 0-10 | % W = 0-15 | % Ti = 0-3 |
| % Ta = 0-3 | % Zr = 0-3 | % Hf = 0-3, | % V = 0-4 |
| % Nb = 0-3 | % Cu = 0-4 | % Co = 0-6, | % S = 0-1 |
| % Se = 0-1 | % Te = 0-1 | % Bi = 0-1 | % As = 0-1 |
| % Sb = 0-1 | % Ca = 0-1, | | |

the rest consisting of iron and unavoidable impurities, wherein $$\%\ Ceq = \%\ C + 0.86 * \%\ N + 1.2 * \%\ B,$$

$$\%\ Ni + 9 * \%\ Mn + 5 * \%\ Si < 8,$$

and $$\%\ Mo + \tfrac{1}{2}\%\ W > 1.2,$$

said steel having a low scattering structure permitting a thermal diffusivity higher than 8 $mm^2/s$
and wherein:

$$xCeq*(xMo+0.5*xW)/(xCr+xV+xNb)>8$$

where:
xCeq—weight percent Carbon;
xMo—weight percent Molybdenum:
xW—weight percent Tungsten;
xV—weight percent Vanadium;
xNb—weight percent Niobium;
where xCr, xV and xNb are the real weight percents even if present at concentrations lower than 0.05%.

2. A steel according to claim 1, wherein at least 80% weight of the carbides are carbides of primarily Fe, Mo or W, alone or in combination.

3. A steel according to claim 2, wherein no other single metallic element is present in solid solution within the Fe, Mo and/or W carbides in a concentration higher than 10% weight.

4. A steel according to claim 2, wherein the % C in the carbides is at least partly replaced by % N and/or % B.

5. A steel according to claim 1, wherein no single element is present in solid solution within the Fe metallic matrix embedding the carbides in a concentration higher than 0.5% except % Ni and/or % Mn.

6. A steel according to claim 1, wherein no single element is present in solid solution within the Fe metallic matrix embedding the carbides in a concentration higher than 0.1% except % Ni.

7. A steel according to claim 1, wherein:

$$0.03 < xC_{eq} - AC[xMo/(3AMo) + xW/(3AW) + xV/AV] < 0.165$$

where:
xCeq—weight percent Carbon;
xMo—weight percent Molybdenum;
xW—weight percent Tungsten;
xV—weight percent Vanadium;
AC—carbon atomic mass (12.0107 u);
AMo—molybdenum atomic mass (95.94 u);
AW—tungsten atomic mass (183.84 u);
AV—vanadium atomic mass (50.9415 u).

8. A steel according to claim 1, wherein:
% Cr<0.2, % Si<0.2 and % Ni>2.99.

9. A steel according to claim 1, wherein % Cr<0.1.

10. A steel according to claim 1, wherein % Si<0.1.

11. A steel according to claim 1, wherein % Cr<0.05 and % Si<0.05.

12. A steel according to claim 1, wherein % Mo=2-10, and 3<% Mo+½·% W<11.

13. A steel according to claim 1, wherein:

| | | | |
|---|---|---|---|
| % $C_{eq}$ = 0.26-0.4 | % C = 0.26-0.4 | % N = 0-0.45 | % B = 0-0.3 |
| % Cr < 0.5 | % Ni = 2.99-6 | % Si < 0.3 | % Mo = 2.5-8 |
| % W = 0-5. | | | |

14. A steel according to claim 1, wherein:

| | | | |
|---|---|---|---|
| % $C_{eq}$ = 0.28-0.36 | % C = 0.28-0.36 | % N = 0-0.4 | % B = 0-0.25 |
| % Cr < 0.3 | % Ni = 2.99-5 | % Si < 0.25 | % Mo = 3-6.5 |
| % W = 1-4. | | | |

15. A die, tool or part comprising at least one steel according to claim 1.

16. A steel, for a hot work tool steel, having the following composition, all percentages being in weight percent:

| | | | |
|---|---|---|---|
| % Ceq = 0.20 – 1.2 | % C = 0.20 – 1.2 | % N = 0 – 0 – 1 | % B = 0 – 1 |
| % Cr < 0.05 | % Ni = 1.0 – 9 | % Si < 0.05 | % Mn = 0 – 3 |
| % Al = 0 – 2.5 | % Mo = 0 – 10 | % W = 0 – 15 | % Ti = 0 – 3 |
| % Ta = 0 – 3 | % Zr = 0 – 3 | % Hf = 0 – 3, | % V = 0 – 4 |
| % Nb = 0 – 3 | % Cu = 0 – 4 | % Co = 0 – 6, | % S = 0 – 1 |
| % Se = 0 – 1 | % Te = 0 – 1 | % Bi = 0 – 1 | % As = 0 – 1 |
| % Sb = 0 – 1 | % Ca = 0 – 1, | | |

the rest consisting of iron and unavoidable impurities, wherein

% C*eq* % C+0.86*% N+1.2*% B, and

% Mo+½% W>1.2 and wherein:

$$xCeq*(xMo+0.5*xW)/(xCr+xV+xNb)>8$$

where:
xCeq—weight percent Carbon;
xMo—weight percent Molybdenum:
xW—weight percent Tungsten;
xV—weight percent Vanadium;
xNb—weight percent Niobium;
where xCr, xV and xNb are the real weight percents even if present at concentrations lower than 0.05%.

17. A steel, for a hot work tool steel, having the following composition, all percentages being in weight percent:

| | | | |
|---|---|---|---|
| % $C_{eq}$ = 0.26 – 0.4 | % C = 0.26 – 0.4 | % N = 0 – 0.45 | % B = 0 – 0.3 |
| % Cr < 0.5 | % Ni = 2.99 – 6 | % Si < 0.3 | % Mn = 0 – 3 |
| % Al = 0 – 2.5 | % Mo = 2.5 – 8 | % W = 0 – 5 | % Ti = 0 – 3 |
| % Ta = 0 – 3 | % Zr = 0 – 3 | % Hf = 0 – 3, | % V = 0 – 4 |

-continued

| | | | |
|---|---|---|---|
| % Nb = 0 – 3 | % Cu = 0 – 4 | % Co = 0 – 6, | % S = 0 – 1 |
| % Se = 0 – 1 | % Te = 0 – 1 | % Bi = 0 – 1 | % As = 0 – 1 |
| % Sb = 0 – 1 | % Ca = 0 –1, | | |

the rest consisting of iron and unavoidable impurities, wherein

% C*eq*=% C+0.86*% N+1.2*% B, and

% Mo+½·% W>1.2 and wherein:

$$xCeq*(xMo+0.5*xW)/(xCr+xV+xNb)>8$$

where:
xCeq—weight percent Carbon;
xMo—weight percent Molybdenum:
xW—weight percent Tungsten;
xV—weight percent Vanadium;
xNb—weight percent Niobium;
where xCr, xV and xNb are the real weight percents even if present at concentrations lower than 0.05%.

18. A steel, for a hot work tool steel, having the following composition, all percentages being in weight percent:

| | | | |
|---|---|---|---|
| % $C_{eq}$ = 0.28 – 0.36 | % C = 0.28 – 0.36 | % N = 0 – 0.4 | % B = 0 – 0.25 |
| % Cr < 0.3 | % Ni = 2.99 – 5 | % Si < 0.25 | % Mn = 0 – 3 |
| % Al = 0 – 2.5 | % Mo = 3 – 6.5 | % W = 0 – 4 | % Ti = 0 – 3 |
| % Ta = 0 – 3 | % Zr = 0 – 3 | % Hf = 0 – 3, | % V = 0 – 4 |
| % Nb = 0 – 3 | % Cu = 0 – 4 | % Co = 0 – 6, | % S = 0 – 1 |
| % Se = 0 – 1 | % Te = 0 – 1 | % Bi = 0 – 1 | % As = 0 – 1 |
| % Sb = 0 – 1 | % Ca = 0 – 1, | | |

the rest consisting of iron and unavoidable impurities, wherein

% C*eq*=% C+0.86*% N+1.2*% B, and

% Mo+½·% W>1.2 and wherein:

$$xCeq*(xMo+0.5*xW)/(xCr+xV+xNb)>8$$

where:
xCeq—weight percent Carbon;
xMo—weight percent Molybdenum:
xW—weight percent Tungsten;
xV—weight percent Vanadium;
xNb—weight percent Niobium;
where xCr, xV and xNb are the real weight percents even if present at concentrations lower than 0.05%.

* * * * *